US007952302B2

(12) United States Patent
Becattini et al.

(10) Patent No.: US 7,952,302 B2
(45) Date of Patent: May 31, 2011

(54) LIGHTING UNIT, A SYSTEM COMPRISING IT AND A CONTROL METHOD THEREOF

(75) Inventors: Andrea Becattini, Arezzo (IT); Davide Tazzari, Arezzo (IT); Filippo Vernia, La Spezia (IT)

(73) Assignee: Power-One Italy S.p.A., Arezzo (IT)

( * ) Notice: Subject to any disclaimer, the term of this patent is extended or adjusted under 35 U.S.C. 154(b) by 407 days.

(21) Appl. No.: 12/251,885

(22) Filed: Oct. 15, 2008

(65) Prior Publication Data

US 2009/0102398 A1 Apr. 23, 2009

(30) Foreign Application Priority Data

Oct. 18, 2007 (EP) ..... 07425652

(51) Int. Cl.
*H05B 37/02* (2006.01)
*G08B 1/08* (2006.01)

(52) U.S. Cl. ..... 315/294; 315/195; 315/318; 340/538; 340/3.3

(58) Field of Classification Search ..... 315/294, 315/195, 312, 318; 340/538, 533, 3.3, 3.31, 340/3.32
See application file for complete search history.

(56) References Cited

U.S. PATENT DOCUMENTS

| | | | | |
|---|---|---|---|---|
| 5,471,119 | A * | 11/1995 | Ranganath et al. | 315/307 |
| 6,388,396 | B1 * | 5/2002 | Katyl et al. | 315/294 |
| 6,400,103 | B1 * | 6/2002 | Adamson | 315/292 |
| 2005/0231125 | A1 | 10/2005 | Becattini | |

FOREIGN PATENT DOCUMENTS

| | | |
|---|---|---|
| GB | 2274852 | 6/1995 |
| GB | 2345998 | 7/2000 |

* cited by examiner

*Primary Examiner* — Daniel D Chang

(74) *Attorney, Agent, or Firm* — Waddey & Patterson; Mark J. Patterson

(57) ABSTRACT

A method for controlling the operation of a lighting unit comprising a plurality of lighting elements and a dimmable power supply unit with an output for adjusting the brightness of at least some of the lighting elements. The method provides that for at least one dimmer setting at least one real electrical parameter is measured, as a function of the absorption of the lighting elements and that the measured electrical parameter is compared with at least one previously-stored theoretical value.

16 Claims, 3 Drawing Sheets

LIGHTING UNIT, A SYSTEM COMPRISING IT AND A CONTROL METHOD THEREOF

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application which is hereby incorporated by reference: European Patent Application No. 07425652.0 filed Oct. 18, 2007.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates to improvements to the lighting systems. More in particular, the present invention relates to improvements useful in public lighting systems or, in general, in systems presenting a plurality of lighting units distributed over a wide area, such as, for instance, a street lighting system.

In lighting systems that are distributed over wide areas, such as, for instance, in the public street lighting systems for urban areas, airports or the like, there is a need to monitor the proper operation of the lighting elements to enable their rapid replacement in the event of their failure. to perform an automatic and continuous surveillance of such systems, it has been suggested (WO-A-2004/08887) to apply to each lighting element a control unit that powers the lamp and controls the proper operation thereof. In the event of a failure, the control unit, using power line communication over the power supply network, transmits a message to a collecting unit, by means of a power line modem (PLM). In this way, a plurality of lamps can be monitored continuously and, in the event of a fault, the collecting unit receiving the failure message notifies an operation center, by means of a radio communication, via GSM or other suitable means, in the case even via cable or fiber optics, so that the operation center can take action to repair the fault.

US 2005/0231125 describes a lighting system in which a control unit performs a test on the proper operation of the lamp with which it is associated and, at the same time, it dims the lamp following instructions received through the power supply network from a collecting or control unit. Also in this case, a PLM is provided for each control unit and for each of the one or more collecting units to enable the exchange of information, instructions and/or data, including information on any faulty operation of the lamp, via power line communication over the power supply network.

BRIEF SUMMARY OF THE INVENTION

According to one aspect, the invention provides a method and a control unit that enable control of the proper operation of a group of lamps or lighting elements that together constitute a lighting unit, wherein the lighting elements are controlled by a single dimmable power supply unit. This is particularly useful, for instance, in the public lighting systems, in which there may be groups of several lamps or lighting elements installed on a lamp post, a single control and power supply unit being provided at the base thereof, which also adjusts the brightness of the lamps belonging to this group.

The invention is substantially based on the concept of storing at least one power absorption curve for the set of lamps or lighting elements associated with the same power supply unit, under proper operating conditions, and then of using said curve as a reference parameter during the normal operation of the power supply unit. If the power actually absorbed by the set of lighting elements at a given dimmer setting (i.e. partialization of the brightness) does not coincide, at least to within an acceptable tolerance range, with the value of the curve recorded under proper operating conditions of all the lighting elements, then a fault message is generated. On the other hand, if the two values coincide (i.e. the value of the power absorbed comes within an acceptable tolerance range around the theoretical value determined by the stored curve), this means that the lighting elements are functioning properly.

In this way it is possible to control a plurality of lighting elements by means of a single dimmable unit, with a substantial reduction in the installation costs, while retaining the opportunity to monitor the proper operation of the lighting unit.

The curve of the theoretical power values can be stored, for instance, in the form of a table in a non-volatile memory, for example an EPROM, interfaced with a microcontroller or a microprocessor of the power supply unit.

In other embodiments, the curve of the theoretical power values can be acquired and stored (in the form of values inserted in a table, for example), in a resident memory in a separate device from the power supply unit. For instance, the various lighting devices can communicate with a collecting unit that receives and stores in an own memory the power absorption values under proper operating conditions of the various devices or power supply units. These values can be transmitted, for instance, by power line communication via a PLM during a data acquisition phase performed by each power supply unit. In this case, the comparison between the theoretical power absorption and the power actually absorbed by each unit at one or more dimmer settings can be done by the data collection device or unit for all the power supply units, which merely communicate the value of the absorbed power to the collecting unit.

According to a possible embodiment, the invention therefore provides a method for controlling the operation of a lighting unit comprising a plurality of lighting elements and a dimmable power supply unit with a single output for said plurality of lighting elements, wherein, for at least one dimmer setting, i.e. for at least one partialization level of brightness, the power absorbed by the lighting elements is measured and the measured power is compared with at least one reference value, any difference between the measured power and the reference value triggering a fault signal.

There is notwithstanding the possibility of using an electrical parameter other than the electrical power absorbed, provided it depends on the power absorbed by the lighting elements associated with a given lighting unit.

According to an improved embodiment of the invention, the method also provides an acquisition phase, in which by varying the dimmer setting, i.e. the partialization of the brightness of the lighting elements of the lighting unit, a set of power absorption values is stored. Said values are stored in a non-volatile memory and used in the subsequent operation of the lighting unit to control the proper functioning of the set of lamps or lighting elements, by comparing the power actually absorbed with the theoretical power absorption stored during the previous data acquisition phase for the same dimmer setting, i.e. degree or level of partialization.

According to a further aspect, the invention relates to a lighting unit comprising a plurality of lighting elements and a dimmable power supply unit with one output for a dim command for dimming at least some of the lighting elements, wherein the power supply unit preferably comprises a memory in which values of power absorbed by said plurality of lighting elements are stored, and a controller programmed to compare a value of power absorbed during the operation of the lighting unit with at least one of said stored values.

The lamps or lighting elements of a given lighting unit may all be the same, in which case it is also possible to determine with ease not only whether there is a fault or a malfunction, but also how many lamps or lighting elements are faulty, since each lighting element absorbs approximately the same power and therefore the difference between theoretical power absorption under proper operating conditions and power actually absorbed can be used to identify the number of faulty lamps involved, simply by dividing this difference by the power absorbed under normal operating conditions by each single lamp at a given dimmer setting, or brightness partialization.

However, the method and the lighting unit according to the invention enable advantages also in the case of the lamps or lighting elements of the same lighting unit differing from one another, and even in the case of only some of the lamps being dimmable. In any case, having stored a curve of the power absorption as a function of the brightness partialization degree (even if dimming only affects some of the lamps), the curve of the actual power absorption for a given dimmer setting will depart from the theoretical curve whenever one or more lamps are faulty, whether they are dimmable or not dimmable.

Further advantageous characteristics and embodiments of the invention are set forth in the attached claims and will be described in more detail below with reference to the accompanying drawings, which illustrate non-limiting embodiments of the invention.

BRIEF DESCRIPTION OF THE SEVERAL VIEWS OF THE DRAWINGS

The invention will be better understood by following the description below and the accompanying drawings, which show practical non-limiting embodiments of the invention. More in particular, in the drawings.

DETAILED DESCRIPTION OF THE INVENTION

Figure 1:
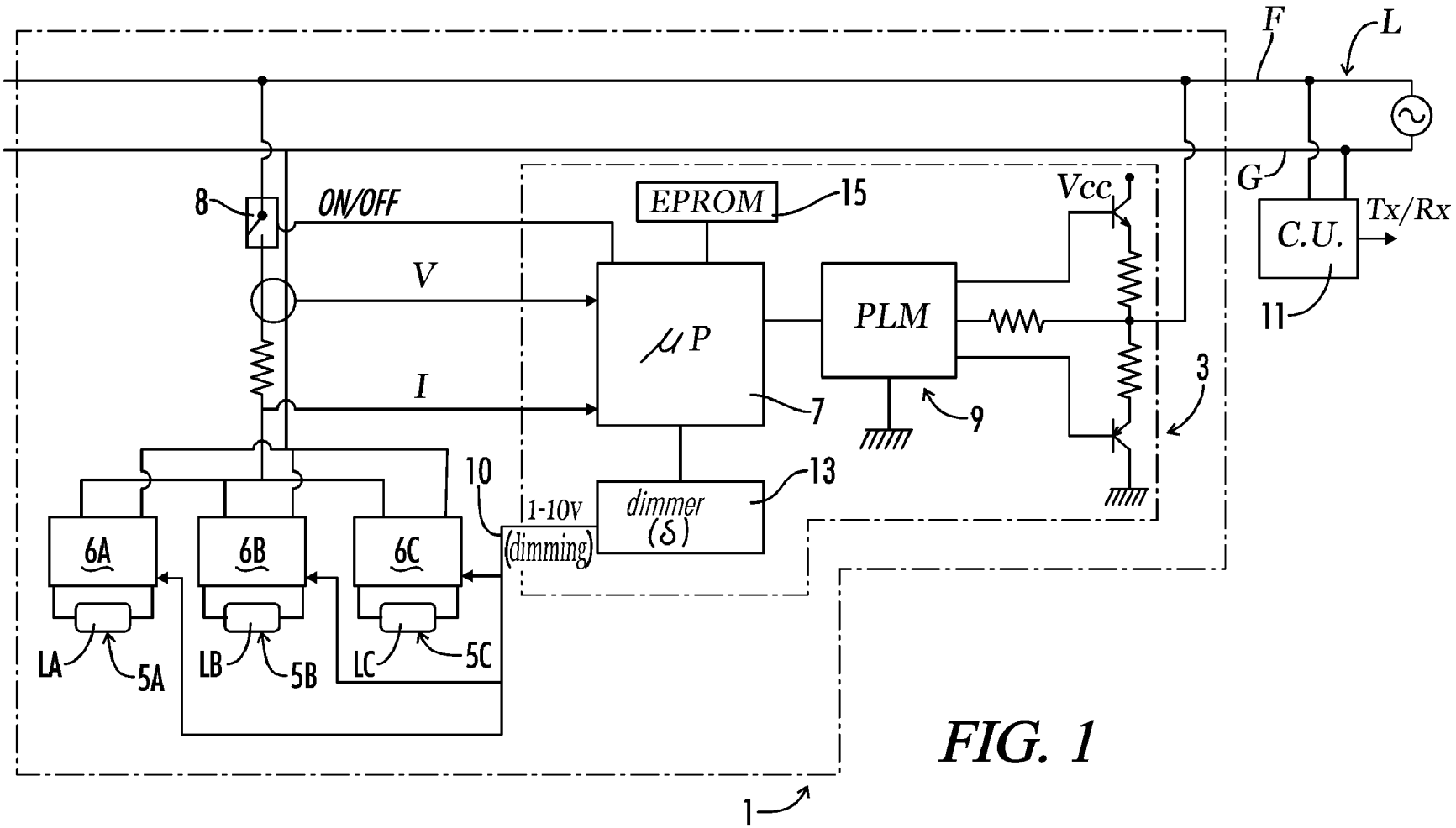
FIG. 1 is a wiring diagram of a portion of a power supply network with a lighting unit and a data collecting unit connected to the network.

FIG. 1 shows a portion of a power supply line L, for example a portion of an urban network for the distribution of electrical energy to a public lighting system. F and G indicate respectively the phase (or one of the phases in a three-phase system) and the neutral.

One or more lighting units are connected to the line L, one of which is schematically illustrated in FIG. 1 and indicated by the number 1. Schematically, the lighting unit comprises a power supply unit 3 for powering a plurality of lighting elements, in the example shown three lighting elements 5A, 5B, 5C, each fitted with a ballast 6A, 6B, 6C and a lamp La, Lb, Lc. Reference number 7 indicates a microcontroller or microprocessor of the power supply unit 3, that receives as input a signal proportional to the current 1 absorbed by the three lighting elements 5A-5C and a signal proportional to the voltage V at the terminals of the lighting elements. Based on these signals I and V, the microcontroller can calculate the active power W globally absorbed by the lighting elements.

The microcontroller is interfaced with a PLM (Power Line Modem) 9 connected to the line L for transmitting and receiving information by means of power line communication over the power supply line L. In this way each power supply unit 3 connected to the power supply line L can communicate with a collecting unit 11. Several power supply units can communicate with a same collecting unit 11. According to some embodiments of the invention, each lighting unit can communicate alternatively with more than one collecting unit 11. In general, a plurality of lighting units 1 and a more limited number of collecting units 11 will be connected to one power supply network.

The collecting units 11 can send instructions to the lighting units, for example on/off switching or dimming (i.e. reducing the brightness) commands for the various lighting elements of the single lighting units, all according to methods already described, for instance, in the patent publications previously mentioned in the introductory part of the specification. In an entirely schematic manner in FIG. 1, reference number 8 indicates a power switch for turning the lighting elements 5A, 5B, 5C on and off, the opening and closing of this switch being controlled by the microcontroller or microprocessor 7. Reference number 10 indicates a low-voltage line that provides a variable-voltage dimming signal, e.g. between 1V and 10V, to adjust the brightness of the lamps or lighting elements. In the example illustrated, the dimming signal is provided in parallel to all the lighting elements, because in this case all the lamps are dimmable. In other embodiments, one or more of the lamps or lighting elements of the lighting unit 1 may lack the brightness adjustment function, in which case this/these lamp(s) are obviously not connected to the line 10.

In some embodiments, the collecting units may request information from one or more lighting units 1 on the operating conditions of the single units, or these units may communicate alarm conditions, information concerning faults or the like to their respective collecting unit 11. In some embodiments, the collecting unit can be connected to an operations center, for example by means of a radio broadcasting system, or a GSM telephone system or any other suitable means. In this case, the operator at the operations center is informed directly of any faults.

Generally speaking, the layout is designed so that an operations center can be promptly informed of any faults occurring in the various power supply units 3 and/or the respective lighting elements 5A, 5B, 5C.

In other embodiments, the collecting units have a user interface, for example a display with variously-colored LEDs, that provides information on the operating conditions of the lighting units connected to this collecting unit. In this case, the operator can assess the operating conditions of several lighting units by examining the data provided by the collecting unit. Solutions of this type can be adopted, for instance, for lighting systems of modest dimensions, for small villages or for other installations such as airports, industrial plants, or the like.

Again with reference to the diagram in FIG. 1, in some embodiments, at least some of the power supply units 3 connected to the power supply network comprise a dimming circuit, generically and schematically indicated as a dimmer 13, interfaced with the microcontroller 7. The dimming circuit generates the brightness adjusting signal on the line 10. In some embodiments, the system described can receive from the collecting unit 11 an instruction that establishes the dimming percentage, i.e. the proportional reduction of the brightness in relation to the maximum brightness of the lighting elements 5A, 5B, 5C associated with the lighting unit 1. This signal is processed by the microcontroller 7, which sends an instruction to the dimming circuit 13, which adjusts the voltage on the output 10 to obtain the required dimming effect on the lighting elements 5A-5C.

Each of the one or more collecting units can send a common dimming instruction to all the lighting units, or an instruction addressed to just one or another, or to several of these lighting units 1, in order to selectively obtain a specific reduction in the brightness of only some of the lighting units 1. In other embodiments, the collecting units send only a timer-controlled signal to the lighting units 1, each of which has a microcontroller 7 programmed for switching the lamps on or off, and/or for reducing the brightness in certain previously-established time periods. The timetable is provided by the signal transmitted by the collecting units.

In a configuration of this type, it is hard to identify whether any one or more of the lighting elements 5A, 5B, 5C are faulty on the basis of the current and voltage absorption signals, because there is no known reference point, especially if the lighting unit operates at variable dimmer settings.

According to the invention, this problem is overcome by providing the power supply unit 3 with information relating to the proper operation of all the lighting elements and programming the microcontroller 7 so that it can perform a test on the proper operation of the lighting elements on the basis of said information.

Figure 2:
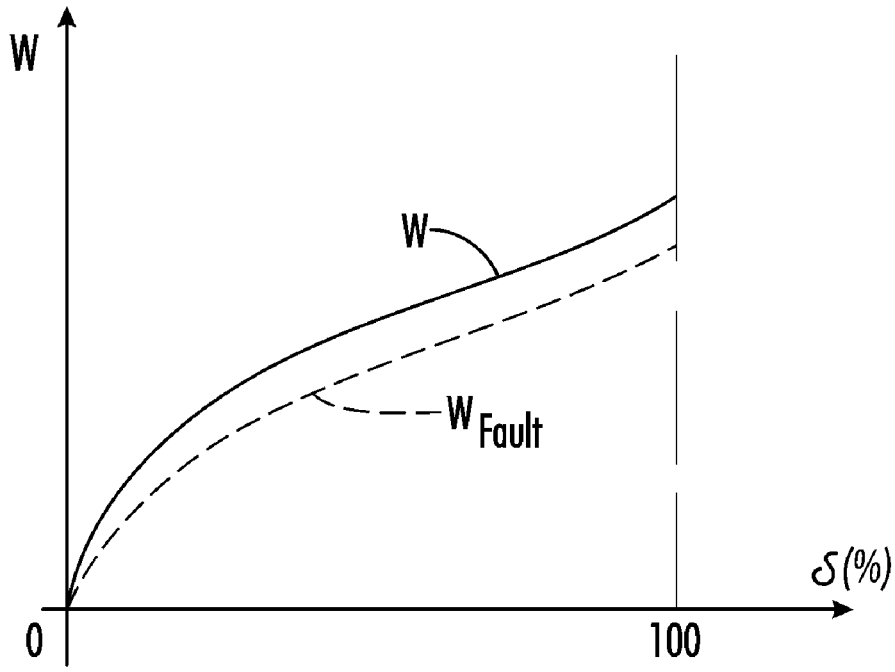
FIG. 2 is a graph showing power absorption as a function of the dimmer setting for a generic lighting unit.

FIG. 2 shows the generic trend of the power absorbed as a function of the dimmer setting by a set of lighting elements 5A-5C. It should be understood that the number of three dimmable lighting elements is considered here simply as an example and that this number may vary to suit specific project requirements, and, moreover, that the same lighting unit 1 may also comprise not dimmable lamps. In the diagram in FIG. 2, the Y axis shows the power W globally absorbed by the lighting elements and the X axis shows the percentage dimming, i.e. the duty cycle of the pulse-width modulation (PWM) or other control signal common to the various lighting elements regulated on the basis of the 1-10V signal on line 10. As shown in the diagram in FIG. 2, the curve W(δ) has a rising but non-linear trend as a function of the dimmer setting. If one or more of the lighting elements are faulty, the curve changes substantially. Purely by way of example, W indicates the power absorption curve under proper operating conditions of the lighting elements, while $W_{fault}$ indicates the power absorption curve in the event of a faulty lamp or lighting body.

By storing the points of the curve W in a non-volatile memory, e.g. in the form of a table, the microcontroller 7 can perform a check on the power absorption measured for a given value of the duty cycle and compare the measured value with the theoretical value which the power should present at that given value of duty cycle, i.e. for that given reduction in the brightness (dimming percentage or degree) if the lamps and functioning correctly. Any discrepancy between the two values, i.e. the one measured on the basis of the values recorded for I and V and the theoretical value given by the stored data, indicates that at least one of the lamps or lighting elements 5A-5C controlled by the dimming circuit 13 of the lighting unit 1 is faulty.

It should be understood that, to allow for the unavoidable inaccuracies and tolerances involved, the discrepancy must exceed a minimum threshold value that represents the tolerance range up to which it can be assumed that the power absorption measured is substantially consistent with the theoretical value.

In FIG. 1, reference number 15 indicates a non-volatile memory, for example an EPROM, in which the curve W can be stored. As explained previously, the curves can be stored in the form of tables of values in which, for each of a discrete series of values of the duty cycle (i.e. of dimming), there is a corresponding value of the theoretical power absorbed W. However, this information can also be stored in other formats, for example as coefficients of a polynomial that approximates the real curve, or in any other suitable manner. The important point is simply the fact that the microcontroller 7 has information available on the link between the duty cycle (or, in more general terms, the dimmer setting) and the power absorption under proper operating conditions of all the lamps.

When a lighting unit 1 is installed or repaired, or when its configuration is modified, e.g. by increasing the number of lamps involved, or changing their characteristics, the power supply unit 3 can perform a learning cycle, during which the microcontroller 7 gradually increases the brightness of the lamps by modifying the dimming signal on the line 10. For various values of the dimmer setting, the absorbed power W is detected by multiplying the voltage signal V by the current signal I. Pairs of values for W, δ (the degree or percentage of dimming) are stored in the EPROM 15, or in whatever other memory is being used.

In subsequent operation, the microcontroller 7 performs a check, at regular intervals for instance, or when prompted to do so by the collecting unit, or simply each time it is switched on, on the proper operation of the lamps by calculating the power actually absorbed and comparing it with the theoretical power absorption value that is associated in the memory 15 with the brightness reduction degree (δ) set at the time of the test. The theoretical value that this power absorption should have according to the previously stored data. If there is a discrepancy, for example an error message or an alarm is generated, or anyway information is produced and transmitted, preferably by means of power line communication over the line L, to the collecting unit 11, which then proceeds to inform the operations center.

Figure 3:
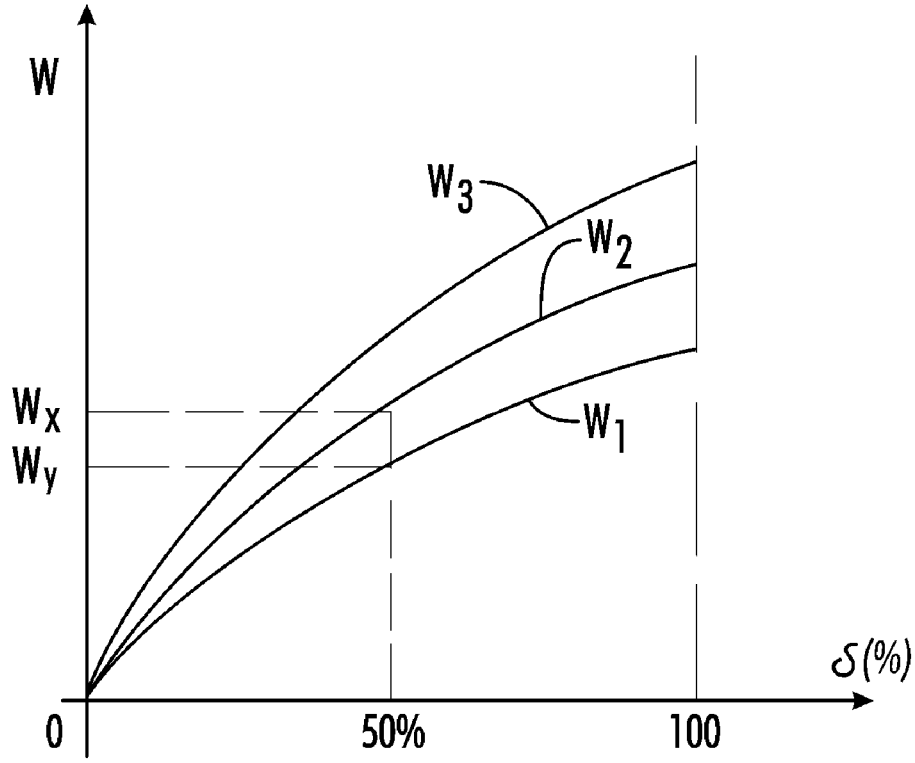
FIG. 3 is a graph showing power absorption as a function of the dimmer setting for a multiple lamp lighting unit.

If the lamps La, Lb, Lc are all the same, then the number of faulty lamps can be deduced from the amount of the difference between the theoretical power absorption and the actual power. FIG. 3 shows how this can be done. FIG. 3 shows the power absorption curves, under proper operating conditions, for one lamp (curve W1), two lamps (curve W2) and three lamps (curve W3). Supposing that there are three lamps, if, for instance, the value of the power absorbed, at a given duty cycle value corresponding to a dimmer setting of 30%, amounts to approximately Wy, this means that one of the lamps 5A, 5B, 5C is faulty. On the other hand, if the value of the power absorbed amounts to approximately Wx, this means that two of the lamps are faulty. The concept can naturally be extended to a larger number of lamps or lighting elements.

Figure 4:
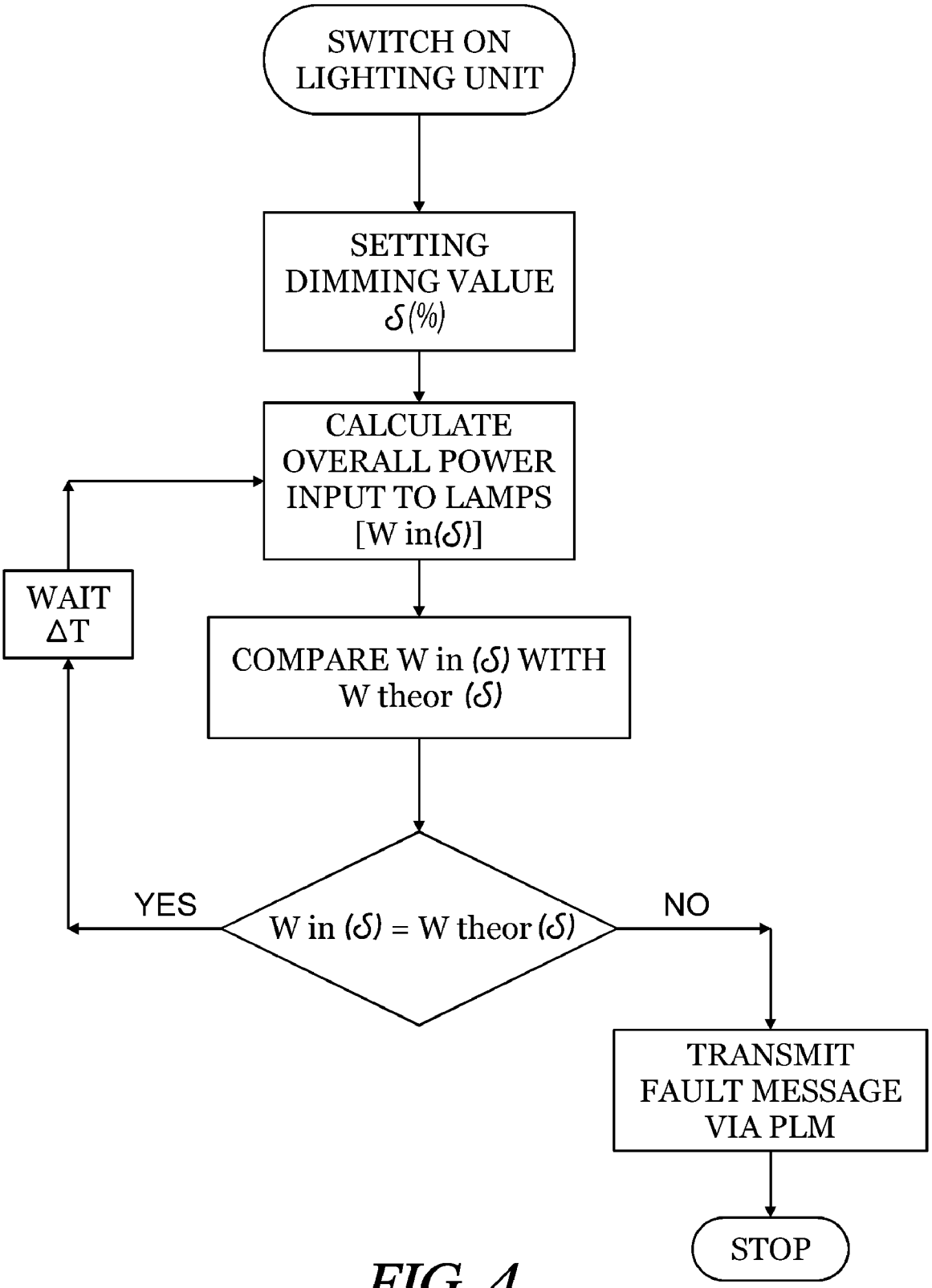
FIG. 4 is a flow chart of the control method in an embodiment of the invention.

FIG. 4 summarizes the control method used by the microcontroller 7 in a flow chart. In the flow chart, $W_{IN}(\delta)$ indicates the value of the power input for the lighting elements and $W_{theor}(\delta)$ indicates the theoretical power absorption for the same dimmer setting. The example shows how the device behaves when it is switched on, with a given value of brightness partialization and subsequent iterative check on the power absorption. In this case, the control is performed repeatedly with a time interval ΔT. If a fault or malfunction is detected, it is assumed that the system will stop performing the iterative test and go into a standby mode. The system will be restored when the faulty lamp is repaired.

The phase of learning of the power absorption curve as a function of the dimmer setting or partialization degree can be performed manually by the operator, who enables a learning function once the installation or the repair of the lighting units 1 has been completed. For this purpose, a suitable user interface may be provided on the controller 7, by means of which the operator can start the data acquisition or learning cycle. When this occurs, the microcontroller 7 can assign a ramp from δ=0% to δ=100% to the dimming signal on the line 10, with a continuous or stepping trend, during which the power absorbed is detected for a sufficient number of dimmer settings, and the pairs of values W, δ are stored in the non-volatile memory 15. In this way the lighting unit 1 will be able to perform a suitable check on the operation of the group of lighting elements even in the event of any lamps found faulty being replaced with a different type of lamp, e.g. of higher or lower power, or of a dimmable lamp being replaced with a not dimmable lamp, and vice versa.

It is understood that the drawing merely shows one practical embodiment of the invention, which may vary in form, realizations and arrangements without however departing from the scope of the concept underlying the invention. Any use of reference numbers in the claims that follow is made merely for the purpose of facilitating the reading thereof in the light of the above description and of the accompanying drawings, and does not limit in any way the scope of protection defined by the claims.

Thus, although there have been described particular embodiments of the present invention of a new and useful Lighting Unit, a System Comprising it, and a Control Method Thereof, it is not intended that such references be construed as limitations upon the scope of this invention except as set forth in the following claims.

What is claimed is:

1. A method for controlling the operation of a lighting unit comprising a plurality of lighting elements and a dimmable power supply unit with an output for adjusting the brightness of at least some of said lighting elements, the method comprising:

wherein, for at least one dimmer setting, at least one real electrical parameter is measured as function of power absorption by said plurality of lighting elements; and the measured electrical parameter is compared with at least one previously stored theoretical value.

2. A method according to claim 1, wherein a difference between the measured electrical parameter and the reference value gives rise to a fault signal.

3. A method according to claim 1, further comprising the steps of:

storing a plurality of reference theoretical values, corresponding to the real electrical parameter function of the power absorption of said plurality of lighting elements at different dimmer settings, when said lighting elements are functioning properly; and during the operation of said lighting unit, comparing the real electrical parameter at least for one dimmer setting with the reference value corresponding to said dimmer setting.

4. A method according to claim 2, further comprising the steps of:

storing a plurality of reference theoretical values, corresponding to the real electrical parameter function of the power absorption of said plurality of lighting elements at different dimmer settings, when said lighting elements are functioning properly; and during the operation of said lighting unit, comparing the real electrical parameter at least for one dimmer setting with the reference value corresponding to said dimmer setting.

5. A method according to claim 2, wherein said fault signal is transmitted by power line communication over the power supply line of the lighting unit.

6. A method according to claim 1, wherein said electrical parameter is determined by the power absorbed by said lighting elements.

7. A lighting unit comprising:

a plurality of lighting elements;

a dimmable power supply unit with an output for a signal for adjusting the brightness of at least some of said lighting elements;

wherein said power supply unit comprises a controller programmed to acquire at least one effective value of an electrical parameter function of the power absorption during the operation of said lighting unit at a given dimmer setting, said effective value being used for comparison with a corresponding, previously-stored theoretical value of said electrical parameter corresponding to a proper operating condition of the lighting unit.

8. A lighting unit according to claim 7, wherein said electrical parameter is the power absorbed.

9. A lighting unit according to claim 7, wherein said power supply unit comprises a memory in which values of said electrical parameter function of the absorption of said plurality of lighting elements for at least one dimmer setting are stored.

10. A lighting unit according to claims 8, wherein said power supply unit comprises a memory in which values of said electrical parameter function of the absorption of said plurality of lighting elements for at least one dimmer setting are stored.

11. A lighting unit according to claim 7, wherein said controller is programmed to perform a comparison between said actual value of the electrical parameter and the previously-stored theoretical value.

12. A lighting unit according to claim 11, wherein said controller is programmed to signal an anomaly if said actual value differs from said stored value.

13. A lighting unit according to claim 7, wherein said controller is programmed to perform a data acquisition phase and to store a curve of said electrical parameter as a function of the dimmer setting when the lighting elements of said lighting unit are functioning properly.

14. A lighting unit according to claim 7, further comprising a device for transmitting a fault signal over the power supply line.

15. A lighting system comprising:

a plurality of lighting units;

each of the lighting units comprising a plurality of lighting elements, a dimmable power supply unit with an output for a signal for adjusting the brightness of at least some of said lighting elements, and wherein said power supply unit comprises a controller programmed to acquire at least one effective value of an electrical parameter function of the power absorption during the operation of said lighting unit at a given dimmer setting, said effective value being used for comparison with a corresponding, previously-stored theoretical value of said electrical parameter corresponding to a proper operating condition of the lighting unit; and each of the plurality of lighting units is connected to a power supply line.

16. A lighting system according to claim 15, further comprising at least one collecting unit connected to said power supply line, said collecting unit being programmed to receive any fault messages from said lighting units.

* * * * *